US005648120A

United States Patent [19]

Genieys et al.

[11] Patent Number: 5,648,120

[45] Date of Patent: Jul. 15, 1997

[54] METHOD OF ALUMINIZING, IN PARTICULAR FOR ALUMINIZING ELONGATE METAL CAVITIES

[75] Inventors: Emile Genieys, Saint Ouen l'Aumone; Abdelghani Saida, Longevelle-sur-Doubs, both of France

[73] Assignee: European Gas Turbines SA, Paris, France

[21] Appl. No.: 255,740

[22] Filed: Jun. 7, 1994

[30] Foreign Application Priority Data

Jun. 7, 1993 [FR] France ..... 93 06773

[51] Int. Cl.[6] ..... C21D 8/12

[52] U.S. Cl. ..... 427/258

[58] Field of Search ..... 427/258

[56] References Cited

U.S. PATENT DOCUMENTS 4,427,720 1/1984 Gauje ..... 427/253

5,135,777 8/1992 Davis ..... 427/253

FOREIGN PATENT DOCUMENTS

0441674A1 8/1991 European Pat. Off. .

2342351 9/1977 France .

4035790C1 5/1991 Germany .

*Primary Examiner*—Sam Silverberg

*Attorney, Agent, or Firm*—Sughrue, Mion, Zinn, Macpeak & Seas

[57] ABSTRACT

In this method, aluminization is performed by using thermochemical treatment, and an aluminum donor piece (6) based on metallic aluminum is placed in the vicinity of the surface to be treated (2), prior to said treatment. Preferably, said piece is provided with a thin metal coating (10) that withstands the treatment temperature. The invention is particularly applicable to protecting cooling channels in the blades of a gas turbine.

6 Claims, 1 Drawing Sheet

METHOD OF ALUMINIZING, IN PARTICULAR FOR ALUMINIZING ELONGATE METAL CAVITIES

BACKGROUND OF THE INVENTION

Aluminization has been used for many years for protecting hot metal parts, and in particular for improving resistance to corrosion and to oxidation of the exposed surfaces of gas turbine blades. Aluminization consists in enriching with aluminum the metal of the part to be treated, the metal generally being an alloy, and the aluminum enrichment taking place in the vicinity of its surface. Aluminization gives the metal two sets of physical characteristics at high temperatures: the aluminum-rich outer layer guarantees satisfactory resistance to hot corrosion and oxidation without altering the mechanical properties of the non-treated parent metal.

The blades in the hot stages of modern turbines and aviation jet engines are cooled by injecting compressed air into cavities whose shapes are sometimes complex and which constitute cooling channels. Depending on the composition of the blades and the operating temperatures thereof, it is sometimes also necessary to provide protection for the inside surfaces created by those channels.

Various thermochemical methods are known for performing aluminization treatment.

In those methods, aluminium is added by adding or creating in situ a halogenated carrier which decomposes at the surface to be treated so as to add aluminum atoms thereto. The high temperature of such treatment causes a limited amount of intermolecular diffusion of the aluminum in the metal of the substrate constituted by the part to be treated. In this way, aluminum-rich layers are formed at said surface.

The aluminum-adding power of the halogenated carrier is a function of its partial pressure in the gaseous mixture which results from thermochemical equilibrium.

Aluminization treatment may be performed either in a "pack" or by vapor deposition.

Pack treatment is described firstly below.

A pack is constituted by a powder mixture:

an aluminum-rich metal alloy in powder form;

an inert diluent such as alumina in powder form; and a halogenated carrier generator, such as ammonium chloride $ClNH_4$.

The parts to be treated are disposed in the pack, inside a metal case which is then heated in a hydrogen atmosphere.

The halogenated carrier is formed and is charged with aluminum by contact with the particles of the pack. The carrier transports the aluminum by gaseous diffusion to the surface to be treated where it decomposes to give a gaseous decomposition residue. The residue comes back into contact with the metallic aluminum of the pack, thereby regenerating the halogenated carrier.

The equilibrium between the diffusion of the aluminum into the substrate and the gaseous diffusion, as a function of the density of the pack and of its richness in aluminum, has an influence on the aluminum content in the enriched layer which is formed in the substrate. As the pack becomes poorer in aluminum, the activity of the halogenated carrier decreases in the vicinity of the pack.

Vapor deposition treatment enables the activity of a halogenated carrier to be kept constant because it is enriched with aluminum independently of the position of the part. In this way, the metallurgical characteristics of the layer formed can be controlled more accurately.

However, the shapes of the part to be treated can pose problems. That is why it is often necessary to create an artificial flow inside the treatment enclosure. Given the treatment temperatures that are commonly used, it is sometimes difficult to control the quality of the flow easily and effectively.

SUMMARY OF THE INVENTION

More particularly, but not exclusively, the present invention concerns treating the inside surfaces of cavities.

In both of the above-mentioned types of treatment, treating inside surfaces such as those of cooling channels poses a problem that is sometimes insoluble.

When the treatment is performed in a pack, it is usually impossible to ensure that the cavities to be protected are properly filled, it is often difficult to clean the cavities after treatment, and the quantity of donor element which may be inserted in the form of a powder mixture is limited, and sometimes insufficient.

When vapor deposition treatment is performed, it is not easy to ensure that the halogenated carrier flows properly at high temperatures inside the cavities to be treated.

In general, such problems require very specific solutions which must be adapted to each case in point.

A particular object of the invention is to improve the effectiveness of aluminization treatment in simple manner, in particular when the possibilities of adding or creating a suitable halogenated carrier are limited at least locally. Such is the case in particular when the surfaces to be treated are the inside surfaces of elongate cavities such as the cooling channels in gas turbine blades or the like. Another object of the invention is to limit the cost of such treatment.

To these ends, the invention provides a method of aluminizing, in which aluminization is performed by using thermochemical treatment, with an aluminum donor piece based on metallic aluminum being placed in the vicinity of the surface to be treated, prior to said treatment. Preferably, said piece is provided with a thin metal coating that withstands the treatment temperature.

BRIEF DESCRIPTION OF THE DRAWINGS

A description of how the present invention may be implemented in the above-described circumstances is given below by way of non-limiting example and with reference to the diagrammatic figures of the accompanying drawing, in which, where the same element is shown in both figures, it is designated by the same reference, and in which.

DETAILED DESCRIPTION OF THE PREFERRED EMBODIMENT

Figure 1:
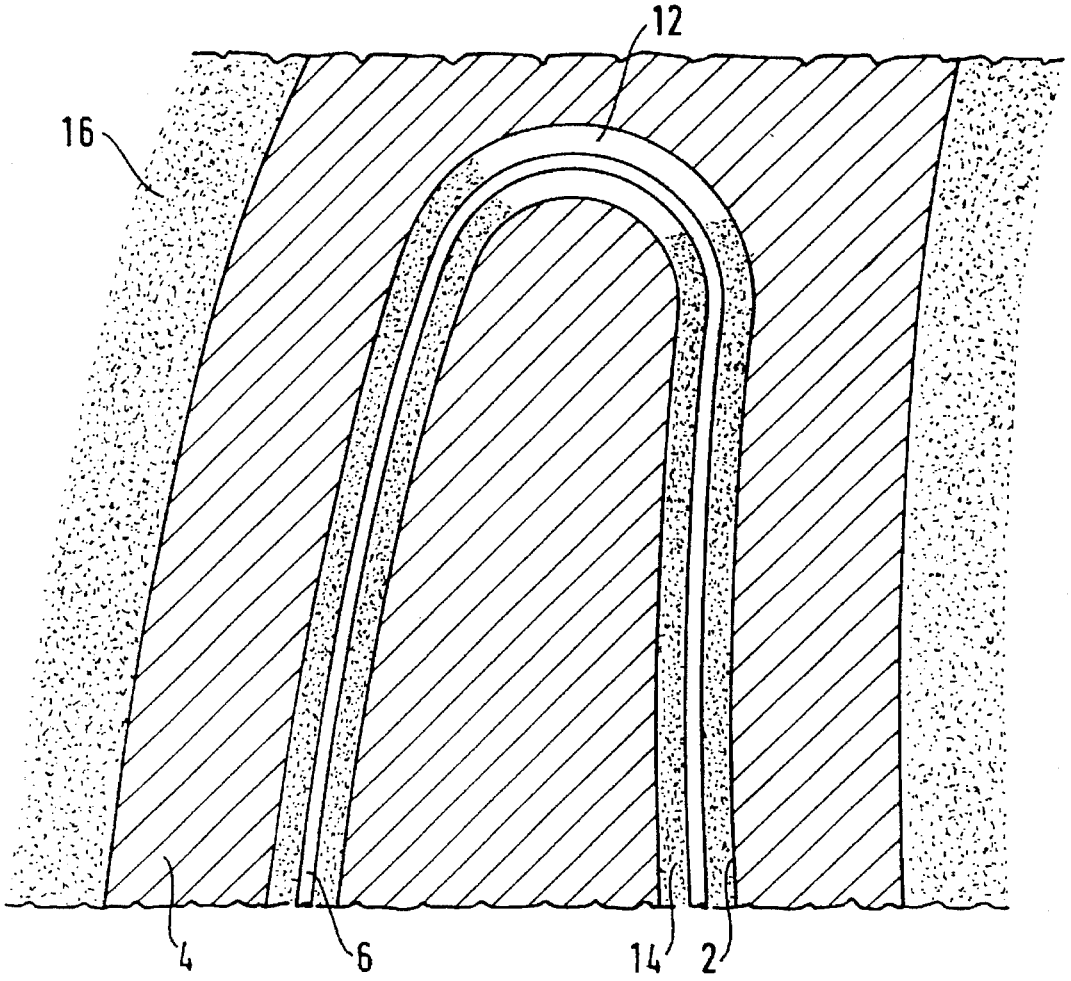
FIG. 1 is a fragmentary section view through a turbine blade during aluminizing treatment of the present invention, the section surface being parallel to the main faces of the blade.
Figure 2:
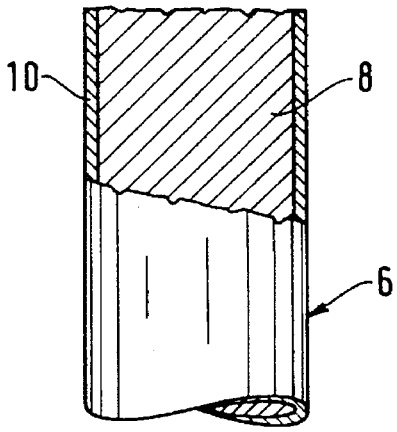
FIG. 2 is an enlarged detail view of a donor piece shown in FIG. 1.

In general, a method of the invention includes the following steps that are known in thermochemical treatment:

a halogenated carrier carrying aluminum in a chemically combined form and as a vapor is brought to the vicinity of and in contact with a surface to be treated 2 belonging to a metal substrate 4 that has a high melting point; and the surface is heated for a limited time to a treatment temperature that is higher than the melting point of aluminum but that is lower than the melting point of the substrate; that temperature, e.g. 1,040° C., is such that the halogenated carrier decomposes, thereby releasing aluminum atoms onto the surface, and is such that said atoms diffuse into the substrate in the vicinity of the surface; by decomposing, the carrier also forms a decomposition residue that remains as a vapor.

According to the present invention, prior to the heating step, an aluminum donor piece 6 is placed in the vicinity of the surface to be treated. The donor piece may be constituted by a metal core 8 based on aluminum and coated with a thin metal coating 10. The metal of the coating is chosen so that it remains solid and chemically withstands said halogenated carrier and the decomposition residue thereof at the treatment temperature. The coating is thick enough to prevent the core from running during the heating step. The coating is also thin enough to enable aluminum atoms to diffuse through the coating so as to combine with the decomposition residue, thereby regenerating the halogenated carrier.

More particularly, for aluminizing the inside surface of an elongate cavity, the aluminum donor piece 6 has a thin elongate shape like a wire or a strip. When it is installed in the cavity, the piece extends along the length thereof.

The quantity of aluminum contained in the donor piece is chosen so as to guarantee the desired enrichment for the surface to be treated in the vicinity of the piece. Its metal coating 10 is constituted by at least one metal from the group comprising nickel, chromium, and cobalt.

For example, the invention may advantageously be applied to aluminizing an industrial turbine blade provided with twelve channels, each of which has a diameter of 1.5 mm and a length of 250 mm.

In this case, the aluminum donor piece is advantageously in the form of a wire. In particular, the wire could be made of aluminum with an alloy metal. The alloy metal can be chosen to constitute an additive to prevent the donor piece from melting at the treatment temperature. But making such a piece entails manufacturing problems and the brittleness of the alloy prevents wires being made that are of small enough diameter for the case given as an example. That is why, in this case, an electrolytic or chemical deposit of nickel, nickel and chromium, cobalt, or cobalt and chromium is made on a wire made of pure or slightly-alloyed aluminum.

The resulting coated wire is inserted into the channel to be protected. The part containing the wire may then be put into a conventional thermochemical aluminizing pack.

As soon as the temperature in the channels inside the part exceeds the "melting" point of aluminum, the aluminum becomes alloyed with the coating of the wire by intermolecular diffusion. In this way, it creates an aluminum-rich alloy which enables the walls of the channel to be aluminized without a drop of liquid being formed inside the channel and hindering the operation. The choice of the diameter of the wire enables the quantity of aluminum in the donor piece to be matched to the area to be treated.

The speed and the regeneration of the halogenated carrier can be controlled by an appropriate choice of the electrolytic deposits made on the wire.

It is not necessary to add any specific halogenated carrier to the channels since the halogenated carrier that exists in the treatment pack, or in the vapor deposition treatment, can penetrate by gaseous diffusion into the cavity to be treated and can find in situ the regeneration elements required to obtain the desired thermochemical equilibrium.

With the above-mentioned part, the channel having a diameter of 1.5 mm and a length of 250 mm was treated by using a pack having the following composition:

35% AlTi metal powder (30% Al, 70% Ti);

64% $Al_2O_3$ (inert diluent); and

1% $FHFNH_4$ (halogenated carrier generator).

The donor piece 6 was constituted by a wire made of pure aluminum, having a diameter of 0.4 mm, and coated with 5 microns of nickel.

In this way, a layer was formed inside the channel that had the same characteristics as the layer which was formed on the outside surface of the part to be treated:

diffused thickness: 60 μm to 80 μm; and aluminum content: 28% to 35% over 50% of the thickness of the layer.

Tests performed at different levels gave uniform results.

In conclusion, the present invention makes it possible in particular to enrich various alloys with aluminum by thermochemical treatment inside very long channels into which it is difficult to penetrate.

The cross-sections of such channels may be circular or otherwise.

The aluminum is supplied in the form of wires or strips made of pure or slightly-alloyed aluminum and pre-coated with nickel, nickel and chromium, cobalt, or cobalt and chromium.

The quantity of aluminum inserted into the channel is controlled by the choice of the cross-section of the aluminum wire or strip. The activity, i.e. the regeneration speed, of the donor piece constituted in this way is controlled by the choice of the thickness of the metal coating.

The halogenated carrier required for the thermochemical reaction is supplied by the treatment pack or by the atmosphere of the gaseous deposition treatment.

What is claimed is:

1. A method of aluminizing, in particular for aluminizing elongate metal cavities by using thermochemical treatment by means of a gaseous halogenated carrier, said method being characterized by the fact that an aluminum donor piece (6) based on metallic aluminum is placed so that it extends in the vicinity of the surface to be treated (2) and facing said surface prior to said treatment, the method including the following steps:

a halogenated carrier carrying aluminum in a chemically combined form and as a vapor is brought to the vicinity of and in contact with a surface to be treated (2) belonging to a metal substrate (4) that has a high melting point; and the surface is heated for a limited time to a treatment temperature that is higher than the melting point of aluminum but that is lower than the melting point of the substrate, that temperature being such that said halogenated carrier decomposes, thereby firstly releasing aluminum atoms onto said surface so that said atoms diffuse into the substrate in the vicinity of the surface, and secondly forming a decomposition residue that remains as a vapor;

wherein prior to the heating step, an aluminum donor piece (6) is placed so that it extends facing said surface to be treated, the donor piece containing metallic aluminum and a coating that prevents it from liquefying at said treatment temperature so that the piece offers aluminum atoms to said decomposition residue while remaining solid and in place during said heating step.

2. A method according to claim 1, wherein said aluminum donor piece (6) is constituted by a metal core (8) based on aluminum, and wherein the coating is a thin metal coating (10) that coats the core, the metal of the coating remaining solid and chemically withstanding said halogenated carrier and said decomposition residue at said treatment temperature, the coating being thick enough to prevent the core from running during said heating step, and also being thin enough to enable aluminum atoms to diffuse through the coating so as to combine with the decomposition residue, thereby regenerating the halogenated carrier.

3. A method according to claim 1, wherein, for aluminizing the inside surface of an elongate cavity, said donor piece (6) has a thin elongate shape like a wire or a strip, the piece extending along the length of the cavity once it has been placed therein.

4. A method according to claim 2, characterized by the fact that said metal coating (10) is constituted by at least one metal from the group comprising nickel, chromium, and cobalt.

5. A method according to claim 1, wherein said halogenated carrier is supplied by placing a pack (14) containing a powder mixture constituted by a metal based on aluminum, by an inert diluent, in particular alumina, and by a halide, in the vicinity of said surface to be treated, and prior to said heating step.

6. A method according to claim 1, wherein said halogenated carrier is supplied by inserting vapor constituting the carrier into a treatment enclosure containing said metal substrate, and optionally by maintaining circulation of the vapor inside the enclosure.

* * * * *